United States Patent [19]

Peters

[11] 4,038,637

[45] July 26, 1977

[54] ACCESS CONTROL SYSTEM

[76] Inventor: Sherman M. Peters, 5209 S. Vadalia, No. 5, Tulsa, Okla. 74135

[21] Appl. No.: 634,347

[22] Filed: Nov. 24, 1975

[51] Int. Cl.[2] ..... E05B 49/00

[52] U.S. Cl. ..... 340/147 MD; 340/274 C; 340/149 A

[58] Field of Search ..... 340/149 A, 149 R, 147 MD, 340/274 C; 235/61.7 B; 317/134

[56] References Cited

U.S. PATENT DOCUMENTS

| | | | |
|---|---|---|---|
| 3,654,605 | 4/1972 | Honda | 340/151 |
| 3,706,086 | 12/1972 | Farnsworth | 340/151 |
| 3,878,511 | 4/1975 | Wagner | 340/149 A |

*Primary Examiner*—Harold I. Pitts
*Attorney, Agent, or Firm*—Head, Johnson & Chafin

[57] ABSTRACT

A system for controlling access which comprises, at a control point, storage means such as a plurality of decimal switches into which can be stored a series of decimal digits. At a second point where access is desired, there is a single decimal switch which controls an oscillator to create a coded signal containing a plurality of pulses, representative of the decimal digit selected by the switch. This coded signal is transmitted to the control point, where it is decoded. If it corresponds to the decimal digit inserted in the first storage switch, a latch is set. A sequence of coded signals are generated, transmitted, and decoded. Corresponding latches are set at the control point if each signal corresponds to the corresponding decimal switch setting. When a full sequence of signals is completed and alllatches are set, then access is gained. Failure to transmit the correct signal or to use the signals in an incorrect order will fail to set all the latches, and access will be refused.

3 Claims, 1 Drawing Figure

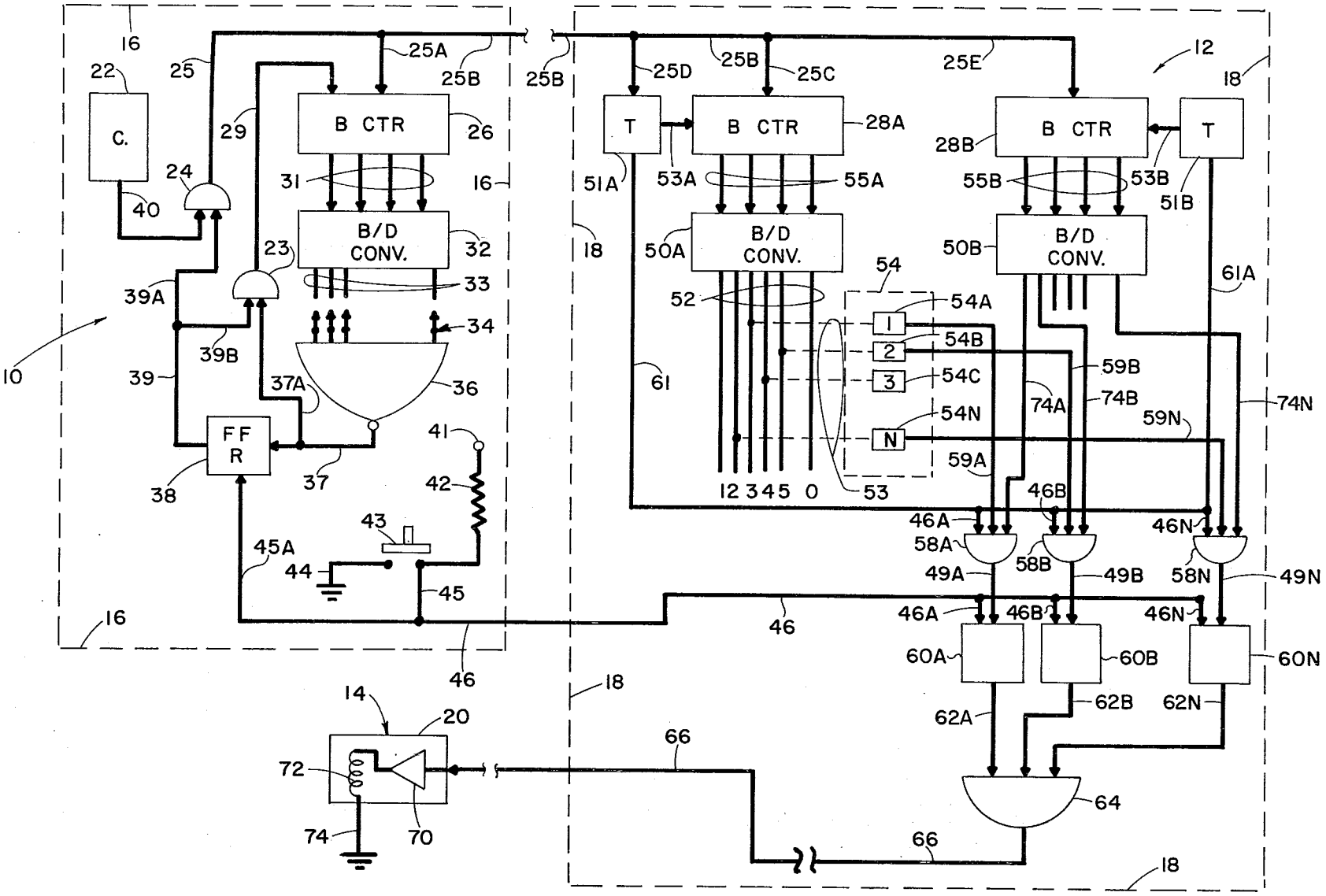
B CTR
B/D CONV.
T
C.
FF R
12 345 0

ACCESS CONTROL SYSTEM

BACKGROUND OF THE INVENTION

This invention lies in the field of electronic circuits for controlling access to areas, information, circuits, and so on. More particularly, it is an access control system in which a number of decimal digits are preselected and set into a storage means at a control point, as a code. At a point at which access is desired (access point), a plurality of signals are sequentially transmitted, which correspond to a second group of decimal digits. At the control point, the signals are received and decoded. If the decimal digits to which they correspond are the same series of decimal digits inserted into the storage means, access is gained.

In the prior art, numerous systems have been devised for controlling access. Many of these involve the use of specific types of physical tokens, cards, or keys which actuate switches in various combinations, etc. Such systems are relatively inflexible because the keys or cards are not easily changeable in case it is desired to change a combination or a code for gaining access. Other systems use multiconductor transmission means, etc.

SUMMARY OF THE INVENTION

It is a primary object of this invention to provide an electronic system for gaining access which involves closing switches in a preselected order corresponding to that of a group of switches in a central control unit.

It is further an object of this invention to provide a system of gaining access in which the code can be changed at any time, simply and rapidly so that once the knowledge of how to gain access may be known by somebody not entitled to access, it can be changed and will prevent access to those who have not been apprised of the change.

These and other objects are realized and the limitations of the prior art are overcome in this invention by providing an access control station in which there are a plurality of decimal switches, which can be set to various decimal digits, in a selected order, to provide a series of decimal digits. This group of decimal digits becomes a code; and when it is repeated at an access point by closing a series of decimal switches in the proper order, corresponding to the code, then access will be gained.

At the point at which access is desired, which will be called the access point, there is a decimal switch comprising a plurality of push button switches. When one button is pushed, it can correspond to any selected digit, and it controls an oscillator to generate a plurality of electrical pulses, which correspond to the decimal digit selected by the switch. This signal comprising one or a plurality of pulses, is transmitted to the control point.

At the control point there are a number of decimal switches which can be preset. These can be set to any selected digit in any selected order. There is a binary counter which counts the number of pulses in each of the signals which are received from the access point. If the number of pulses in the first group or signal corresponds to the setting of the first decimal switch, then a circuit is closed which sets a first latch. At the access point a second switch is closed, corresponding to a second digit. A second signal is generated and transmitted. At the control point the second signal is decoded into a decimal digit. If this corresponds to the digit set in the second switch, then a second latch is set, and so on through a series of signals and decimal digits. When all of the latches are set, a circuit is closed which permits access to be gained at the access point. This circuit can be arranged by means of a solenoid to open a door latch, or pull a door bolt, or in various other ways permit a door to be opened or other access to be gained.

BRIEF DESCRIPTION OF THE DRAWINGS

These and other objects and advantages of this invention and a better understanding of the principles and details of the invention will be evident from the following description taken in conjunction with the appended drawing, which illustrates in schematic fashion one embodiment of this invention.

DESCRIPTION OF THE PREFERRED EMBODIMENT

Referring now to the drawing there are two areas enclosed in dashed outline. One of these indicated generally by the numeral 10 is a means for generating electrical signals at the point at which access is desired. A second dashed outline indicated generally by the numeral 12 comprises apparatus for receiving the signal generated at the point of access, and for decoding these signals and determining whether or not the series of signals corresponds exactly to the series of decimal digits which are selected as the code for gaining access.

Referring more particularly to the dashed outline 16, there is shown a clock or oscillator 22, which produces pulses at a selected rate. The output of the clock 22 goes by lead 40 to a NAND gate 24. The output of the NAND gate 24 goes by lead 25 and 25A to a binary counter 26. Assume that the gate 24 is enabled for a short time, to allow the pulses generated by the clock 22 to pass through to the counter 26. This binary counter has its output on leads 31 connected to a binary to decimal converter 32. The converter 32 has a plurality of output leads 33, one corresponding to each of the decimal digits. If, for example, the transmitted signal which has passed through the gate 24 has seven pulses, and these seven pulses have gone to the binary counter, and have been converted to decimal, then a corresponding potential will be presented on one of the leads 33 corresponding to the decimal digit 7. If the lead on which the potential appears corresponds to the lead on which a switch 34 has been closed, then potential will be applied to the gate 24 and will reset the flip-flop 38 through lead 37 which will remove potential from leads 39 and 39A, and will disable the gate 24, terminating the stream of pulses.

In practice, one of the switches indicated by the numeral 34 which represents a desired digit is closed. This sets a potential on lead 37 and controls the flip-flop 38 to enable the gate 24, permitting the pulses generated by the clock 22 to go to the counter 26. As the count increases, potential appears selectively on each of the output terminals 33 of the converter 32. When potential is on the lead 33 corresponding to the one on which the switch 34 has been closed, then an opposite potential appears, which resets the flip-flop and disables the gate 24. In this way by closing any one of the switches 34, a coded signal comprising a plurality of pulses goes through the gate 24 to the counter 26 and also out on lead 25B to the control station 12.

In order that the entire system will be in condition for the generation and transmission of access signals, a reset key 43 is first pressed. This grounds resistor 42 attached to terminal 41 and generates a signal which passes by lead 45A to reset the flip-flop 38, and also goes by lead 46 to the access control station 12, where it resets all of the latches, which will be described later, and so on.

Repeating the action in the transmitter 10, the reset button 43 is first pushed which resets the flip-flop 38. One of the switches 34 is closed corresponding to a second selected decimal digit. This causes a proper potential on lead 37, which sets the flip-flop 38, provides a logical 1 signal on 39 and 39A, and enables gate 24 to transmit pulses from the clock 22 through lead 40 A. These pulses then travel by line 25 and 25A to the binary counter 26. When the potential appears on leads 37 and 39, they go through leads 37A and 38B to the AND gate 23 which enables the binary counter 26 to start counting, and it counts the pulses which are passing through lead 25. The binary counter 26 puts signals on the output leads 31, which correspond to the number of counts being counted. This signal going to the binary to decimal converter 32 puts appropriate signals on one or the other of the output leads 33. When this signal appears on the line which has been closed through switch 34, the gate 36 operates to change its output potential and to disable gate 24 and stop the transmission of pulses on output line 25.

Referring now to the apparatus at the control point, indicated within the dashed outline 18, there is a reset lead 46 which goes into this box from the access point apparatus 10. There is also a signal line 25B which carries coded signals. There is an output line 66 which is enabled in order to operate an access control device 14, when required.

The transmitter 10 has means for coding electrical signals in accordance with decimal digits which are selected and corresponding to which appropriate switches are closed. Thus when Switch No. 7 is closed, for example, a number of pulses will be transmitted on lead 25B corresponding to the decimal digit 7. In the receiver 12, there is a binary counter 28A having output leads 55A which go to a binary to decimal converter 50A. These devices are similar to the counter 26, leads 31 and converters 32 of the transmitter 10. Since the pulses from the clock 22 which go to the binary counter 26 also go the counter 28A, there will be potentials on leads 52 corresponding to those on leads 33.

At the receiver 12 there are a group of decimal switch means 54 having decimal switches 54A, 54B, 54C . . . 54N. These switches can be preset to close circuits to any one of the output leads 52, as indicated by the dashed lines 53. The switches 54 correspond to the switches 34. However, instead of being switch push buttons, they are fixed contacts which can be changed by rotating a wheel, for example, and are in a sense semi-permanent connections to the lead 52. In other words, the switch device 54 is a storage device by means of which a series of decimal digits according to the positions of wheels 1, 2, 3, . . . N can be preset, to provide a code, when when transmitted from a transmitting station 10 in terms of coded pulses on lead 25B, will gain access.

Since this code, which involves the plurality of switches 54, can be manually reset at any time, the code word which gains access, or rather the code number, can be changed at will, with great speed and simplicity. After the code number is set into the switches 54 and the proper persons who are to use the access system are informed, then they simply depress the proper switches 34 in the transmitter at successive time intervals, in the proper order, according to the code number. When this is done, access is gained.

The output of the switches 54 each go to a separate NAND gate 54A, 58B . . . 58N over leads 59A, 59B . . . 59N.

There is a timer 51A which is connected by lead 25D to the signal lead 25D, and this provides a control 53A going to the counter 28A, which enables the counter to count during a selected time interval which may be of the order to 50 to 100 milliseconds, or some such time period, sufficiently long to include the transmission of the group of pulses which will come through the gate 24. The enabling voltage which goes to enable the counter 28A also goes by lead 61 and leads 64A, 64B . . . 64N of the corresponding gates 58, and these gates then become enabled during the time that the counter 28A is counting the coded pulses on line 25D.

There is a second counter 28B is the detector station 12 which is connected to the lead 25E. This counter, however, does not count the individual pulses, but on its output lead 55B provides signals which correspond to the number of coded signals which are transmitted. In other words, each time a switch 34 is depressed and a group of pulses representative of that particular switch or digit are transmitted, the separate pulses are counted in counter 28A, but the counter 28B is advanced one unit, so that with the first coded signal on 25B it sends a signal to the binary to decimal converter 50B and sends the signal on output lead 74A to enable the gate 58A. When the next coded signal is sent from the transmitter 10, a corresponding enabling potential is present on leads 74B, which enables the second gate 58B, and so on, until a complete series of signals has been sent and the last signal will then enable the gate 58N, by signal on the line 74N.

The outputs of the gates 58 go by corresponding leads 49A, 49B . . . 49N to a group of latches of flip-flops 60A, 60B . . . 60N. The outputs of the latches 60 on leads 62A, 62B, 62C . . . 62N go to a NAND gate 64. The output of the gate 64 goes by lead 66 to an access control device indicated generally by the numeral 14. This can be any type of electrical control device that permits access to a door or gate, or to an electrical system or whatever is desired, to be controlled by this access control system. Typical of such device would be an electrically operated door bolt 20. The signal on line 66 would be amplified by amplifier 70 and would control a solenoid 72 to control the bolt, etc. In general, the output signal on lead 66 will be devised to control any electrical apparatus, such as to start a motor or turn on lights, or open gates, or do any desired operation, selectively, by sending a series of coded pulses out from the transmitter along the lead 25B.

Consider that a first coded signal has been sent from the transmitter which comprises a group of pulses on lead 25. This group of pulses has been generated and consists of the precise number of pulses corresponding to which one of the switches 34 has been closed. That number of pulses corresponds in the code of this apparatus, to a selected decimal digit. In the receiver 12 where the code has been stored in switch assembly 54, assume that the first switch 54A has been set to a decimal digit say 3 which means that the lead 53 has been connected to an appropriate lead say 3 of the converter 50A. If the transmitted pulse was generated by closing switch 3 of the group 34, then the coded signal on lead 25C will cause an appropriate voltage to be present on lead 3 of the converter output 52, and thus there will be an output signal on lead 59A to the gate 58A. For a selected interval of time set by timer 51A during which there is potential on lead 61, and the gates 58 are enabled, this appropriate signal on line 59A and the corresponding signal on 74A, which says that this is the first coded pulse received, will together cause gate 58A to output a logical 1 signal on lead 49A, to enable and set the latch or flip-flop 60A, and to put a logical 1 signal on the lead 62A.

After the interval of the delay set into the time delay 51A, the counter 28A is disabled, and the gates 58 are disabled and nothing happens until the reset button 42 is again pressed, and a second selected switch 34 is pressed, which could be the same as the preceding one or any other digit, of course. A new coded signal is then generated in the transmitter 10 and is sent by lead 25B. This counted in the binary counter 28A, and a new lead 52 is selected, which, if it corresponds to the setting of the switch 54B, will put appropriate signal on lead 59B to the gate 58B. Again, there will be an enabling signal on the lead 46B; and since this is the second coded signal transmitted, the appropriate potential will be present on the output of the converter 50B. This will cause an output signal on 49B to set the second latch 60B, which is set, and puts an appropriate output signal on lead 62B to the gate 64.

This process of resetting the switch 43, depressing appropriate switch 34 to generate a selected coded signal on lead 25, decoding these signals and detecting potentials on the preset switches 54 to sequentially set latches 60A continued until a prearranged number of pulse signals are generated equal in number to that of the switches 54. Then, if all the latches have been set, the gate 64 operates to grant access.

Each time the timer 51A operates to enable gates 58, it places potential on lead 61A to timer 51B which places signal on lead 53B and advances the counter 28B one unit. Thus counter 28B counts the number of signals which have been sent from 10, and correspondingly switches the detector from one to the other of latches 60. This ensures that the sequence of signals sent correspond in decimal digits to the sequence of decimal digits set into switches 54.

What has been described is an electronic system for generating at a transmitting or access point a series of electrical signals, each signal comprising one or more electrical pulses. The number of electrical pulses in each signal is indicative of a corresponding decimal digit, and the number of pulses generated correspond to which one of a series of switches is depressed and contact made to a selected output of a binary to decimal converter, the input of which is a counter which counts the pulses. In other words, the combination of counter, converter, and switches corresponds to a preset counter. By pushing a switch 34, a series of pulses of precisely controlled number are generated by the gate 24 and are transmitted by lead 25B to a control station.

At the control station, a storage device comprising a plurality of decimal switches have been prepositioned, and therefore have been preset to selective numbers of counts. Means are provided for sequentially connecting the output of a counter system to one or the other of the series of switches so that each signal of a selected number of pulses is compared individually to the preset digital values inserted into the switches 54. If the coded signals correspond in precise number of pulses to the decimal values stored in the switch 54, and are in the proper sequence, then appropriate latches are sequentially set. When all latches are set, the access is gained.

While this apparatus has been described in terms of clocks, gates, counters, converters, flip-flops, latches and so on, each of these devices are well-known integrated circuit devices. They are fully described in catalogs and textbooks and are available on the market, so that further detail is not necessary. However, the designation numbers for most of these devices are listed below for purpose of reference: Clocks and timers, 22, 51: LM 555 Flip-flop 38: CD 4013 Gates 24, 23: CD 4011 Binary Counters 26, 28: CD 4518 Binary to decimal converters 32, 50: CD 4028 Gates 36, 64: CD 4068 Gates 58: CD 4023 Latches 60: CD 4044

It will be clear also, that a timer similar to 51A, 51B can be set to control the signal on 66 to 20, so as to grant access fro a selected interval of time only.

It is well known in the design of logic circuits such as these, that they can be designed with negative or positive logic, that is, a signal which is required to cause a specific operation can be sent from one point to another as a logical 1, which corresponds to a positive voltage, or as a logical zero which corresponds to a negative or zero voltage. The circuits of the drawing do not indicate all possibilities and are shown as positive logic for convenience. It is well understood that they can be redrawn in other ways to accomplish the same type of operation. Also, there can be substitution of other logic elements to accomplish the same type of signal generation, transmission and detection.

While the invention has been described with certain degree of particularity, it is manifest that many changes may be made in the details of the construction and the arrangement of components. It is understood that the invention is not to be limited to the specific embodiments set forth herein by way of exemplifying the invention, but the invention is to be limited only by the scope of the attached claim or claims, including the full range of equivalency to which each element or step thereof is entitled.

I claim:

1. A system for access control comprising;

a. storage means at a control location, and means for entering into said storage means signals representative of a first selected series of decimal digits, said storage means being decimal switch means;

b. means at an access location for generating a plurality of sequential signals, which comprises clock means, means to start said clock means; means to count the pulses produced by said clock means, comprising binary counter means; binary to decimal converter means; decimal switch means; and means responsive to said switch means to stop said clock means when said number of pulses corresponds to a selected decimal digit;

each signal comprising a plurality of sequential electrical pulses, the number of pulses in each signal corresponding to the sequential digits in second selected series of decimal digits;

c. means to transmit said sequential pulses of each of said sequential signals from said access location to said control location over a signal conductor;

d. means including binary counter means and binary to decimal converter means for converting said sequential pulses of said sequential signals to sequential decimal digits corresponding to said second selected series of decimal digits; and e. means to compare said sequential decimal digits corresponding to said second selected series of decimal digits to said first selected series to decimal digits;

f. means responsive to said means to compare, to set each of a plurality of latches, one for each of said sequential digits; and g. means responsive to said plurality of latches, set in the proper order, for granting access.

2. The system as in claim 1 in which said means for granting access includes electromagnetic lock means.

3. The system as in claim 1 in which said latch means is responsive to the sequence of said sequential decimal digits.

* * * * *